US009027449B2

(12) United States Patent
Simon

(10) Patent No.: US 9,027,449 B2
(45) Date of Patent: May 12, 2015

(54) CIRCULAR SAW

(75) Inventor: Stephan Simon, Sibbesse (DE)

(73) Assignee: Robert Bosch GmbH, Stuttgart (DE)

( * ) Notice: Subject to any disclaimer, the term of this patent is extended or adjusted under 35 U.S.C. 154(b) by 884 days.

(21) Appl. No.: 12/747,954

(22) PCT Filed: Oct. 31, 2008

(86) PCT No.: PCT/EP2008/064769

§ 371 (c)(1),
(2), (4) Date: Sep. 9, 2010

(87) PCT Pub. No.: WO2009/083298

PCT Pub. Date: Jul. 9, 2009

(65) Prior Publication Data

US 2010/0326251 A1 Dec. 30, 2010

(30) Foreign Application Priority Data

Dec. 21, 2007 (DE) ..... 10 2007 062 256

(51) Int. Cl.
*B27G 19/08* (2006.01)
*B27G 19/02* (2006.01)

(52) U.S. Cl.
CPC ..... *B27G 19/02* (2013.01); *B27G 19/08* (2013.01)

(58) Field of Classification Search
USPC ..... 83/102.1, 477.2
IPC ..... B27G 19/08
See application file for complete search history.

(56) References Cited

U.S. PATENT DOCUMENTS

| | | | | |
|---|---|---|---|---|
| 2,496,613 | A * | 2/1950 | Woodward | 83/477.1 |
| 2,518,684 | A * | 8/1950 | Harris | 83/471.1 |
| 3,566,934 | A * | 3/1971 | Thrasher | 83/102.1 |
| 5,406,710 | A * | 4/1995 | Zaiser | 30/391 |
| 8,127,648 | B2 * | 3/2012 | Arvey | 83/102.1 |
| 8,151,676 | B2 * | 4/2012 | Shibata et al. | 83/102.1 |
| 2004/0159198 | A1 | 8/2004 | Peot et al. | |
| 2006/0096428 | A1 * | 5/2006 | Garcia et al. | 83/102.1 |
| 2010/0037739 | A1 * | 2/2010 | Anderson et al. | 83/58 |

FOREIGN PATENT DOCUMENTS

| | | |
|---|---|---|
| DE | 37 40 200 | 6/1989 |
| DE | 39 12 307 | 10/1990 |
| DE | 91 12 286 | 2/1993 |
| DE | 295 10 061 | 10/1996 |
| DE | 20 2006 01332 | 11/2006 |
| EP | 0 012 404 | 6/1980 |

* cited by examiner

*Primary Examiner* — Kenneth E Peterson
(74) *Attorney, Agent, or Firm* — Kenyon & Kenyon LLP

(57) ABSTRACT

A circular saw including a saw blade (36) which may be rotatingly driven about a rotational axis, and at least one first splitting wedge is described. The circular saw is configured so that the first splitting wedge is movable relative to the rotational axis of the saw blade.

1 Claim, 8 Drawing Sheets

CIRCULAR SAW

FIELD OF THE INVENTION

The present invention relates to a circular saw having a saw blade and a splitting wedge.

BACKGROUND INFORMATION

Circular saws of the aforementioned type are in various embodiments in the related art.

German patent document DE 295 10 061 U1, for example, discusses a hand-held circular saw having a housing on which a base plate having a workpiece support is pivotably mounted. A saw blade together with the associated motor unit is accommodated in the housing in a known manner, it being possible with the aid of the motor unit to rotatingly drive the saw blade about a rotational axis which does not rotate. The saw blade may be moved through the base plate in such a way that the saw blade projects from the workpiece support surface in order to engage with a workpiece situated on the workpiece support surface. At the rear region of the housing, a splitting wedge support is positioned which is fixedly mounted with respect to the rotational axis of the saw blade, and which together with this rotational axis may be moved up and down and swiveled.

A splitting wedge which is normally made of spring steel sheet metal is detachably fastened to the splitting wedge support with the aid of screws, and extends along a region of the outer periphery of the saw blade. While a workpiece is being cut, the splitting wedge engages with the incision provided in the workpiece, so that the splitting wedge guides the hand-held circular saw. In addition, the splitting wedge prevents the workpiece from tilting or recoiling, and shields a portion of the saw blade for protection of the operator. Furthermore, a retractable blade guard which encloses the upper region of the saw blade is mounted on the splitting wedge, and prevents the operator from coming into contact with this upper region of the saw blade. The retractable blade guard also provides protection from flying chips. The retractable blade guard may also be provided with a device for vacuum removal of the chips.

Table circular saws which have a saw table are also known. The saw table includes a workpiece support surface on which a workpiece may be situated. A saw blade together with the associated motor unit is situated beneath the saw table. The saw blade may be moved up and down through the saw table so that the saw blade may be situated to project from the workpiece support surface in order to engage with a workpiece positioned on the workpiece support surface. A splitting wedge is detachably mounted on a splitting wedge support with the aid of screws or the like; similarly as for the previously described hand-held circular saw, the splitting wedge support is fixedly mounted with respect to the rotational axis of the saw blade, and together with the saw blade may be moved up and down and swiveled. The splitting wedge extends along an outer periphery region of the saw blade, and during machining of a workpiece engages with the incision provided in the workpiece. This splitting wedge is also used for guiding the workpiece and protecting the operator.

If work operations are to be carried out using circular saws of the type described above which are impaired by the presence of the splitting wedge, such as an inset cut, for example, in which the saw blade does not cut into the workpiece starting from the edge of the workpiece, but instead penetrates the workpiece surface in the center, the splitting wedge must be uninstalled before such work operations are carried out. The splitting wedge may be reinstalled after such work operations are completed.

However, uninstalling and installing the splitting wedge is time-consuming and therefore costly, which is not desirable in practice.

Furthermore, handling the circular saws during the period of time in which no splitting wedge is provided is extremely hazardous. An in-house study by the applicant has shown that the odds ratio (OR) value for conventional work operations carried out using hand-held and table circular saws is approximately 1.84. The OR value is obtained by taking the ratio of the relative number of work accidents which occur for a given work operation to the relative amount of time that the work operation requires compared to all work operations; for an OR value greater than 1 a work operation is classified as an above-average hazard. For carrying out an inset cut, an OR value as high as approximately 25 has been determined. The occurrence of an extraordinarily large number of accidents during this work step may be explained, at least in part, by the fact that in this case the splitting wedge must be removed. As a result, in normal practice the operator frequently does not immediately reinstall the splitting wedge on the circular saw after completion of such a work operation. Instead, further work operations which could be carried out with the splitting wedge installed are intentionally or unintentionally performed on the workpiece before the splitting wedge is reinstalled. However, for safety reasons it would be desirable to minimize the period of time in which such work operations are carried out with the splitting wedge uninstalled.

An object of the exemplary embodiments and/or exemplary methods of the present invention, therefore, is to provide a circular saw with an alternative design which at least partially eliminates the previously described problems and disadvantages.

SUMMARY OF THE INVENTION

For achieving this object, the exemplary embodiments and/or exemplary methods of the present invention provides a circular saw, a hand-held or table circular saw, for example, which includes a saw blade which may be rotatingly driven about a rotational axis, and at least one first splitting wedge. In the present context, the term "rotational axis" refers to an axis which itself does not rotate, optionally an imaginary axis, about which the saw blade performs its rotary motion.

According to the exemplary embodiments and/or exemplary methods of the present invention, the circular saw is configured in such a way that the first splitting wedge may be moved, and which may be swiveled, relative to the rotational axis of the saw blade. Accordingly, for work operations which may be carried out using a splitting wedge, the splitting wedge may be moved to a position (referred to below as "proper position") in which it extends along a region of the outer periphery of the saw blade, and during the machining of a workpiece engages with the incision provided in the workpiece.

This proper position is advantageously selected in such a way that the free end of the splitting wedge is at the same level as the farthest projecting edge of the saw blade. The splitting wedge is thus able to perform its guiding and protective function in the usual manner. However, if a work operation is to be carried out in which the splitting wedge in its proper position is in the way, such as for an inset cut, for example, in which a cut is made in the workpiece not from the edge but at the center of the workpiece, the operator is able to transfer the splitting wedge to a second position in which the splitting wedge is retracted with respect to the workpiece during machining of the workpiece, so that the splitting wedge does not interfere with carrying out the work operation. The splitting wedge may be moved between these two positions relative to the rotational axis of the saw blade.

Thus, in contrast to the related art it is no longer necessary to uninstall the splitting wedge to carry out certain work operations. Instead, the splitting wedge may be conveniently moved by the operator into appropriate positions, depending on the work operation to be carried out. On the one hand this results in time and cost savings, and on the other hand due to the ease of handling it is more likely that the operator moves the splitting wedge back to the safe proper position as soon as a work operation which is not possible using a properly installed splitting wedge is completed. The safety of the circular saw may accordingly be increased.

The circular saw may be configured in such a way that the first splitting wedge may be moved, manually and/or with the aid of an appropriate drive arrangement, relative to the rotational axis of the saw blade. In the latter-referenced case an operating mechanism, for example, may be provided which may be activated by the operator, using, for example, a switch or the like which causes the splitting wedge to be automatically moved from one position to the other by appropriate drive arrangement.

In addition, at least one retaining arrangement may be provided which is designed in such a way that it is able to fix the first splitting wedge in at least one position. Such fixing is intended to prevent the splitting wedge from inadvertently leaving a defined position.

The retaining arrangement is advantageously designed in such a way that the fixing may be manually removed. In this case the operator is able to remove the fixing of the splitting wedge after a corresponding work operation is completed, so that the splitting wedge may be moved into the corresponding other position.

Alternatively, the fixing may also be automatically removed when a predefined operating condition is present. Thus, for example, fixing of the splitting wedge may be automatically released in the retracted position (second position) with respect to the workpiece to be machined as soon as a workpiece material is no longer present in the region in which the splitting wedge is in its proper position, which is explained in greater detail below with reference to the exemplary embodiments.

The circular saw according to the present invention may be configured in such a way that the first splitting wedge is automatically moved from the second position toward the proper position when at least one predetermined operating condition is present, for example as soon as a workpiece material is no longer present in the region in which the splitting wedge is in its proper position.

For this purpose a pretensioning arrangement, for example, may be provided which, starting from the second position, pretensions the first splitting wedge toward the proper position and automatically transfers the first splitting wedge to the proper position as soon as a workpiece material is no longer present in the region in which the splitting wedge is in its proper position. It may thus be ensured that the splitting wedge is immediately transferred to the proper position which is safe for the operator as soon as this is possible. If, for example, an inset cut is to be made on a workpiece, first the splitting wedge is transferred manually or with the aid of appropriate drive arrangement from the proper position to the second position, and is fixed in this second position, optionally using the at least one retaining arrangement. The saw blade of the circular saw is then brought into contact with the workpiece. As soon as the workpiece is situated above the splitting wedge and is able to counteract the pretensioning of the pretensioning arrangement on account of its own weight, the fixing of the splitting wedge in the second position performed by the retaining arrangement may be removed manually or automatically. After the fixing performed by the retaining arrangement is released, the pretensioning arrangement pushes the splitting wedge toward the workpiece. When the splitting wedge thus engages with the incision provided in the workpiece, or the end of the workpiece is reached in the region of the splitting wedge, the pretensioning arrangement pushes the splitting wedge into the proper position. In other words, the splitting wedge is transferred to the safe proper position as soon as this is possible. The period of time during which an operator is endangered by an unguided and/or exposed saw blade may thus be reduced to a minimum, thus allowing the number of work accidents to be reduced.

Alternatively, the circular saw may be designed in such a way that the first splitting wedge is automatically transferred from the second position to the proper position in response to a signal of at least one sensor which detects the presence of at least one predetermined operating condition. For this purpose, the at least one sensor may, for example, be designed and set up in such a way that it directly or indirectly detects the presence of workpiece material of the workpiece to be cut by the circular saw in the region in which the splitting wedge is in its proper position. Thus, the sensor first checks as to whether the splitting wedge is able to move from the second position further toward the proper position. If the result is positive, the splitting wedge is moved, for example with the aid of an appropriate drive arrangement, to an appropriate extent toward the proper position. This is continued until the proper position is actually reached.

The sensor may, for example, be an optical sensor in the form of a transistor or the like which is situated beneath the workpiece support surface. When workpiece material is present above the workpiece, it covers the optical sensor and prevents ambient light from reaching the sensor. However, if light penetrates through an incision in the workpiece, or if the end of the workpiece is reached, the sensor receives the ambient light and emits a signal to a servomotor, for example, which moves the splitting wedge by an appropriate extent from the second position toward the first position. However, such an optical sensor is disadvantageous in that it does not function when transparent materials such as Plexiglas or the like are machined, or when grooves are cut.

Instead of the optical sensor, a mechanical sensor may be used, for example a sensor in the form of an electrical scanner or the like. The scanner may be situated, for example, on the workpiece support surface for the circular saw in the vicinity of the splitting wedge, and may detect the presence of a workpiece on the workpiece support surface in the region of the splitting wedge. As soon as the sensor detects the state in which a workpiece is not present on the workpiece support surface in the region of the splitting wedge, the sensor emits a signal to a servomotor, for example, which actuates the splitting wedge from the second position toward the first position (proper position).

A further alternative measuring principle is to project a point of light onto the region of the workpiece in the region of the splitting wedge in which an incision is to be provided. The point of light is reflected on the workpiece, whereupon an appropriate sensor element determines whether and to what extent the point of light has been reflected. Based on the presence and distance of the reflection point it may be determined whether a cut has been made on the workpiece. If this is the case, a signal may be emitted to an appropriate drive arrangement which moves the splitting wedge from the second position toward the first position.

It should be self-evident that a number of further measuring principles are possible, such as, for example, distance measurement via propagation time measurement using sound (ultrasound, for example) or light (such as a LIDAR scanner, for example), distance measurement with the aid of triangulation, or via the air resistance of an air jet which may be simultaneously used for chip removal, etc.

Furthermore, in addition to the first splitting wedge, a removable second splitting wedge which is immovable relative to the rotational axis of the saw blade may be provided.

The splitting wedges may be designed in such a way that they may optionally be installed on the circular saw. Alternatively, the first splitting wedge may be produced and provided in such a way that it may be situated in front of or behind the second splitting wedge, or inside the second splitting wedge. In addition, the first splitting wedge may be situated in the second position when the second splitting wedge is installed at the position which accommodates the first splitting wedge in its first position.

The circular saw according to the present invention also advantageously includes at least one signal arrangement which indicates to the operator that the splitting wedge has left the second position. This is particularly important for sawing grooves, in which the depth of the saw cut is less than the material thickness of the workpiece, since in that case the user is unable to see the splitting wedge or the saw blade. The signal arrangement may emit an optical and/or acoustic and/or tactile signal. The signal may, for example, be a mechanical locking sound which may be heard or felt so distinctly that it is perceivable despite the running saw. The signal may also be some other clearly audible sound. Furthermore, a sound generated by the saw itself is possible as a signal, such as a temporary change in the saw blade rotational speed, for example. In addition, use may be made of the motor windings for electromagnetic generation of an audible oscillation. An optical signal may also be used. However, it must be ensured that the optical signal arrangement is situated in such a way that it is always visible to the operator. Furthermore, the optical signal should be strong enough to be perceivable even in bright ambient light.

The present inventions are described as an example, based on non-limiting specific embodiments with reference to the accompanying drawings.

DETAILED DESCRIPTION

Figure 1A:
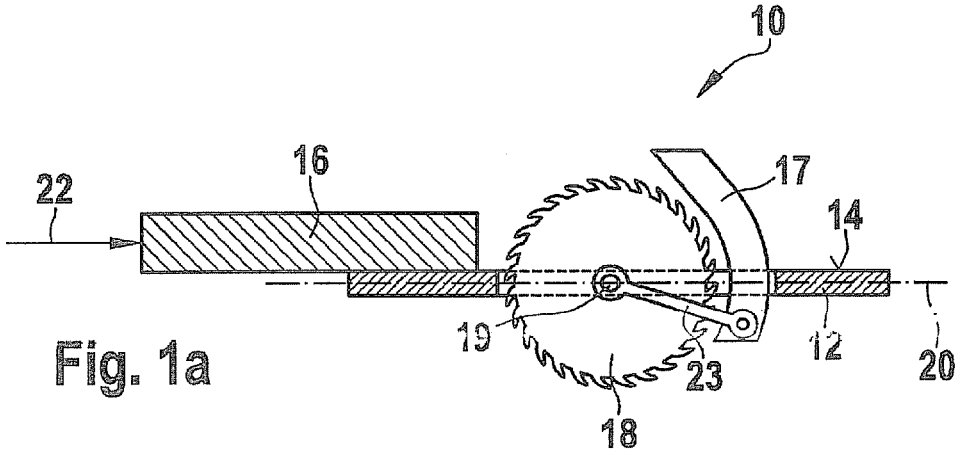
FIG. 1*a*, FIG. 1*b* and FIG. 1*c* show schematic views of various states of a conventional table circular saw while cutting into a workpiece, the cut being made starting from a side edge of the workpiece.

Identical or corresponding components are denoted below by the same reference numerals.

Figure 1B:
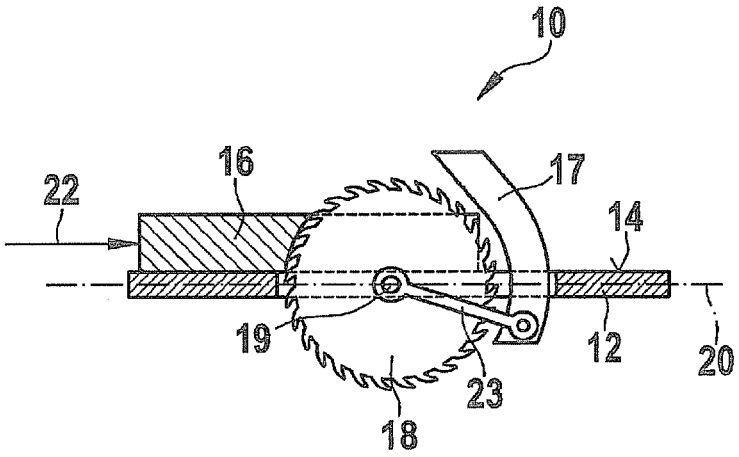
Figure 1C:
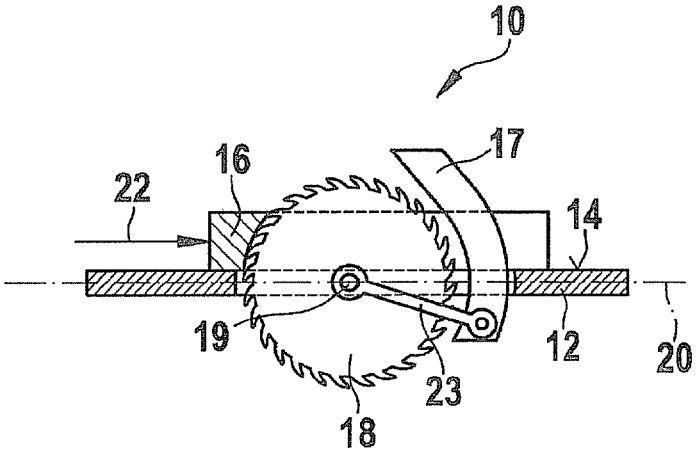

FIGS. 1*a*, 1*b*, and 1*c* show schematic views of states of a conventional table circular saw while a through cut is being made in a workpiece, the cut being made in the workpiece starting from the edge of the workpiece. The table circular saw, which is denoted in general by reference numeral 10 in the stated figures, includes a saw table 12 having a workpiece support surface 14 on which a workpiece 16 is positioned. Table circular saw 10 also includes a saw blade 18, which with the aid of a motor (not illustrated) may be rotationally driven about a rotational axis 19 which does not rotate, and moved up and down. The saw blade may also be swiveled about an axis 20 in a known manner to make angled cuts. A splitting wedge 17 which is used for guiding workpiece 16 and protecting the operator is situated behind saw blade 18 as viewed by the user (to the right in FIGS. 1*a* through 1*c*) when table circular saw 10 is properly operated, and is kept stationary relative to rotational axis 19 of saw blade 18 via arrangement 23. Splitting wedge 17 thus follows an upward, a downward, and a swivel motion of rotational axis 19, the splitting wedge constantly maintaining its position relative to rotational axis 19. When workpiece 16, which is situated on workpiece support surface 14 of saw table 12, is now moved toward saw blade 18 in the feed direction indicated by arrow 22, workpiece 16 engages with saw blade 18 as illustrated in FIG. 1*b*. During this engagement, saw blade 18 cuts an incision in workpiece 16. As soon as the workpiece reaches splitting wedge 17, the splitting wedge penetrates into the through cut as shown in FIG. 1*c*. Accordingly, workpiece 16 is guided by splitting wedge 17, preventing tilting of workpiece 16 and saw blade 18. Recoiling of workpiece 16 is also avoided.

Figure 2:
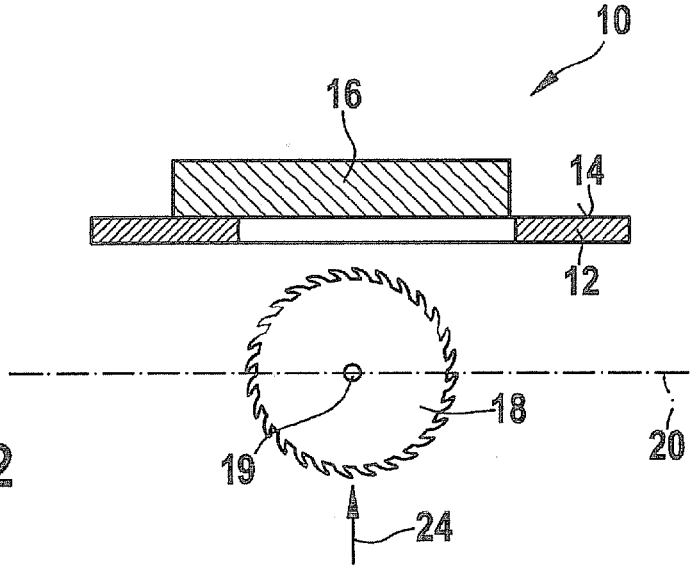
FIG. 2 shows a schematic view of a state of the table circular saw illustrated in FIGS. 1*a* through 1*c*, shortly before beginning an inset cut.

Splitting wedge 17 is normally kept stationary with respect to rotational axis 19 of saw blade 18 with the aid of arrangement 23. However, splitting wedge 17 may be removed if an inset cut is to be made in which saw blade 18 does not cut into the workpiece starting from the workpiece edge, but instead penetrates into the surface of workpiece 16 at the center. After splitting wedge 17 is removed, workpiece 16 is situated on workpiece support surface 14, whereupon rotating saw blade 18 is moved upward from a position beneath workpiece support surface 14, toward arrow 24, to make the inset cut in workpiece 16 as shown in FIG. 2.

However, the previously described uninstallation of splitting wedge 17 is time-consuming and therefore costly, which is not desirable in practice. If, after the inset cut is completed, further work operations are to be carried out using table circular saw 10 which may be performed with splitting wedge 17 installed, splitting wedge 17 must be remounted, which once again is time-consuming and costly. In addition, immediately remounting splitting wedge 17 as soon as this is possible is frequently dispensed with in practice, either unintentionally or for convenience. In this case the operator is exposed to an unnecessary hazard.

Figure 3:
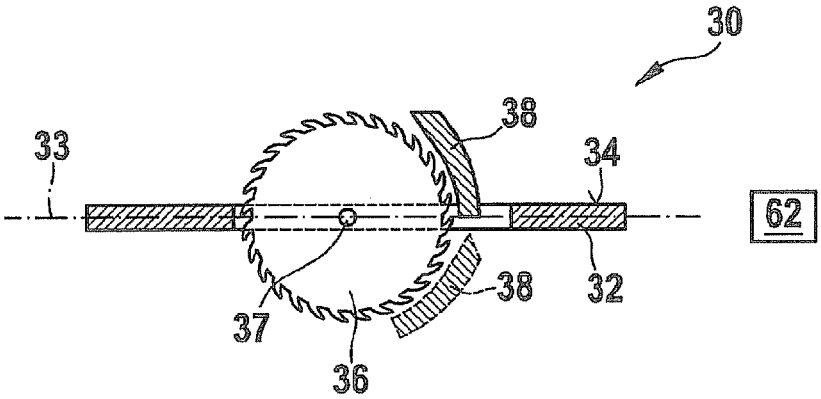
FIG. 3 shows a schematic view of a first specific embodiment of a table circular saw according to the present invention.

FIG. 3 shows a schematic view of a table circular saw 30 according to a first specific embodiment of the present invention. Similarly as for table circular saw 10 illustrated in FIGS. 1*a* through 1*c* and 2, table circular saw 30 includes a saw table 32 having a workpiece support surface 34 and a saw blade 36, which in the same manner as for saw blade 18 of table circular saw 10 may be rotated about a rotational axis 37 which does not rotate, and together with rotational axis 37 may be moved up and down and swiveled about an axis 33. In contrast to table circular saw 10, however, according to the first specific embodiment of the present invention table circular saw 30 includes a splitting wedge 38 which may be moved relative to rotational axis 37 of saw blade 36 between a first (proper) position, in which the splitting wedge extends along a region of the outer periphery of saw blade 36 during machining of a workpiece and is able to engage with the workpiece to be machined, and a second position (consistently illustrated in crosshatch in FIGS. 3 through 6) in which the splitting wedge is retracted with respect to the workpiece during machining of a workpiece. Similarly, for work operations in which splitting wedge 38 is not in the way, splitting wedge 38 is in the proper first position in which it performs its guiding and protective function. However, for other work operations which are not possible to carry out using a properly situated splitting wedge 38, splitting wedge 38 may be transferred to the second position illustrated in crosshatch, in which it is retracted with respect to a workpiece positioned on workpiece support surface 34. Similarly, such work operations may be easily carried out without splitting wedge 38 being in the way. Due to splitting wedge 38 which is situated so as to be movable relative to rotational axis 37, it is not necessary to repeatedly mount and remove splitting wedge 38, thus allowing time and cost savings. Since changing the position of splitting wedge 38 does not take much time, it is also less likely that the operator will refrain from changing the position for reasons of convenience, thus increasing the safety of table circular saw 30.

A receiving arrangement (not illustrated) may optionally be provided on splitting wedge 38, to which a protective cover (not illustrated in the figure) which covers the upper part of saw blade 36 may be fastened if needed. Such a protective cover is very advantageous with regard to safety. However, it must be uninstalled to transfer splitting wedge 38 to the crosshatched second position, which naturally impairs handling of splitting wedge 38. Such a protective cover is known in the related art, and therefore is not described in greater detail.

Figure 4:
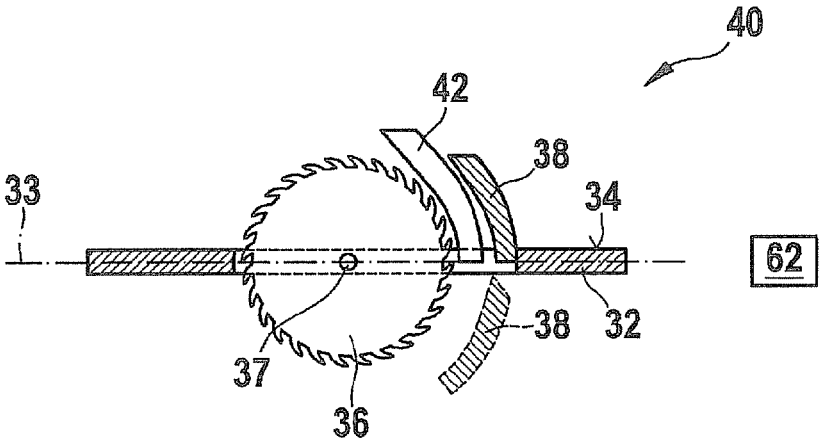
FIG. 4 shows a schematic view of a table circular saw according to a second specific embodiment of the present invention.

FIG. 4 shows a schematic view of a table circular saw 40 according to a second specific embodiment of the present invention. This table circular saw 40 has essentially the same design as table circular saw 30, and includes a saw table 32, a saw blade 36, and a movable splitting wedge 38. In contrast to table circular saw 30, however, an additional, second splitting wedge 42 is provided on table circular saw 40. This second splitting wedge 42 is fixedly mounted relative to rotational axis 37 of saw blade 36, so that the splitting wedge follows an upward, a downward, and a swivel motion of rotational axis 37. In the present specific embodiment, the second splitting wedge is also positioned between first splitting wedge 38 and saw blade 36. A retaining arrangement, likewise not illustrated in greater detail, may be provided on this splitting wedge 42 for fastening a protective cover of the aforementioned type.

In normal operation in which work operations are carried out in which a splitting wedge is not in the way, splitting wedge 42 together with the protective cover mounted thereon is in the installed state. Splitting wedge 38 may be in the first position so that it supports splitting wedge 42. However, splitting wedge 38 may also be placed in the second position so that it is not in use. On the other hand, if a work operation is to be carried out in which a splitting wedge is in the way, such as for an inset cut, for example, second splitting wedge 42 together with the cover mounted thereon is removed, essentially resulting in the configuration illustrated in FIG. 3.

Figure 5:
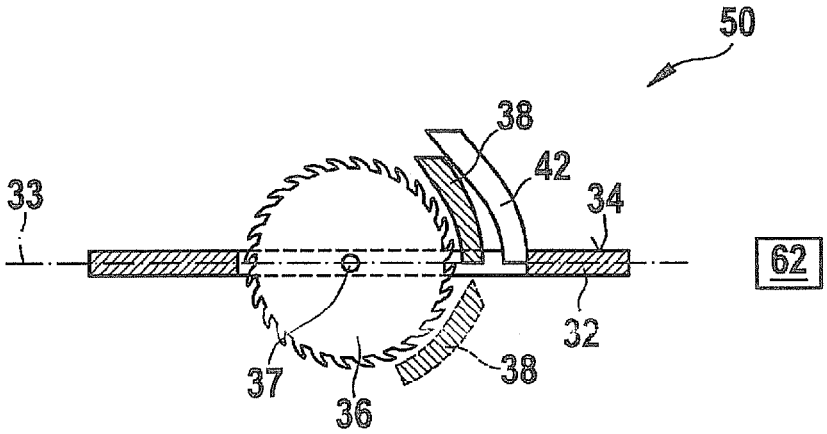
FIG. 5 shows a schematic view of a table circular saw according to a third specific embodiment of the present invention.

FIG. 5 shows a schematic view of a table circular saw 50 according to a third specific embodiment of the present invention. This table circular saw 50 differs from table circular saw 40 illustrated in FIG. 4 only in that second splitting wedge 42 is situated behind movable splitting wedge 38, starting from saw blade 36.

Figure 6:
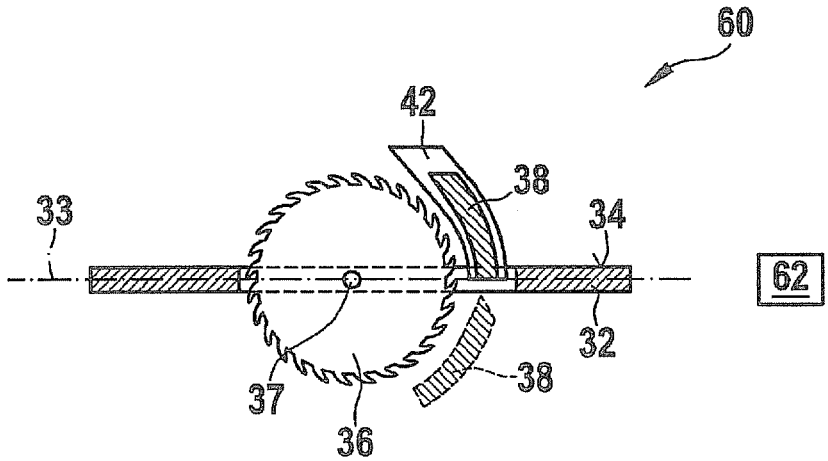
FIG. 6 shows a schematic view of a table circular saw according to a fourth specific embodiment of the present invention.

FIG. 6 shows a schematic view of a table circular saw 60 according to a fourth specific embodiment of the present invention. This table circular saw 60 differs from table circular saws 40 and 50 illustrated in FIGS. 4 and 5, respectively, in that second splitting wedge 42 is designed in such a way that movable splitting wedge 38 in its first (upper) position may be accommodated in the second splitting wedge.

Figure 7:
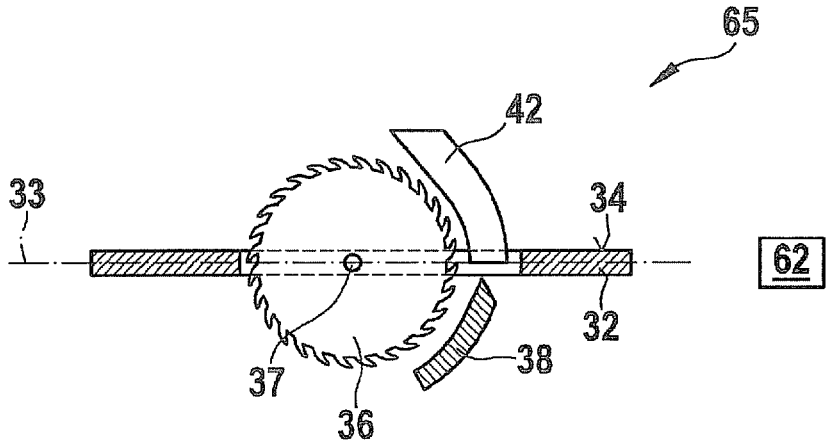
FIG. 7 shows a schematic view of a table circular saw according to a fifth specific embodiment of the present invention.

FIG. 7 shows a schematic view of a table circular saw 65 according to a fifth specific embodiment of the present invention. This table circular saw 65 differs from table circular saws 40, 50, and 60 illustrated in FIGS. 4 through 6 in that second splitting wedge 42 is in the position in which first splitting wedge 38 is in its proper, first position. As long as second splitting wedge 42 is situated as illustrated in FIG. 7, first splitting wedge 38 is in its second position in which it performs no function. However, as soon as second splitting wedge 42 is removed, the configuration illustrated in FIG. 3 results, so that first splitting wedge 38 is able to perform its function.

In addition, each of table circular saws 30, 40, 50, 60, and 65 illustrated in FIGS. 3 through 7 may have at least one retaining arrangement (not shown), with the aid of which first splitting wedge 38 may be fixed in the first and/or second position. Such a retaining arrangement may, for example, be a catch system which engages with first splitting wedge 38 and holds it in the appropriate position. Alternatively, a retaining pin, a servomotor which moves first splitting wedge 38 between the first and second positions, or the like may also be used as a retaining arrangement. The fixing provided by such a retaining arrangement may be manually or automatically removed. In the latter case, an appropriate operating mechanism in the form of a switch or the like may be provided which may be activated by the operator, thus causing the locking to be automatically removed, by an appropriate arrangement.

All table circular saws 30, 40, 50, 60, and 65 illustrated in FIGS. 3 through 7 may be designed in such a way that first splitting wedge 38 may be manually transferred from the first position to the second position, and vice versa.

Alternatively, an appropriate drive arrangement may be provided which transfer first splitting wedge 38 from one position to the other, for example as a response to activating an operating mechanism such as, for example, a switch or the like. Various designs of such a drive arrangement and operating mechanisms are basically known to one skilled in the art, and therefore are not described in greater detail below.

In addition, all table circular saws 30, 40, 50, 60, and 65 illustrated in FIGS. 3 through 7 may have at least one signal arrangement 62, illustrated only schematically in the figures, which indicates to the operator that first splitting wedge 38 has left its second (lower) position. This is particularly important for sawing grooves or sawing a noncontinuous cut, in which the depth of the saw cut is less than the material thickness of the workpiece, since in that case the user is unable to see splitting wedge 38 or saw blade 36. Signal arrangement 62 may emit an optical and/or acoustic and/or tactile signal. The signal may, for example, be a mechanical locking sound which may be heard or felt so distinctly that it is perceivable despite the running saw. The signal may also be some other clearly audible sound. Furthermore, a sound generated by the saw itself is possible as a signal, such as a temporary change in the saw blade rotational speed, for example. In addition, use may be made, for example, of motor windings for electromagnetic generation of an audible oscillation. An optical signal may also be used. However, it must be ensured that the optical signal arrangement is situated in such a way that it is always visible to the operator. Furthermore, the optical signal should be strong enough to be perceivable even in bright ambient light.

The circular saw according to the invention may also be designed in such a way that movable splitting wedge 38 is automatically transferred from the second position to the first position when at least one predetermined operating condition is present. This is explained in greater detail below with reference to FIGS. 8*a* through 8*e*, 9*a* through 9*e*, 10*a* and 10*b*, and 11*a* through 11*c*, which show further specific embodiments of table circular saws according to the invention.

FIGS. 8*a* through 8*e* show schematic views of various states of a table circular saw 70 according to a sixth specific embodiment of the present invention while making an inset cut, in which a through cut is made in a workpiece.

Table circular saw 70 essentially corresponds to table circular saw 30 illustrated in FIG. 3, and includes a saw table 32 having a workpiece support surface 34, a saw blade 36 which rotates about a rotational axis 37, and a splitting wedge 38 which may be moved relative to rotational axis 37 and which is driven by a drive unit 39, shown only schematically. To make the inset cut, splitting wedge 38 is first transferred to its second position by drive unit 39, which may be a servomotor, for example, so that the first splitting wedge is retracted with respect to workpiece 16 during machining of a workpiece 16. Workpiece 16 may then be situated on workpiece support surface 34, above saw blade 36.

Table circular saw 70 also includes a sensor unit 72 which emits a light beam 74 toward workpiece 16. This light beam 74 is reflected at point 76 on workpiece 16 situated on workpiece support surface 34. The reflected light is then received by sensor unit 72. Sensor unit 72 is designed in such a way that it is able to compute a distance h to reflection point 76 based on the received reflected light. If this distance h to reflection point 76 is equal to a known distance H to workpiece support surface 34, this indicates that a workpiece 16 is present on workpiece support surface 34 and lies flush on workpiece support surface 34. However, if distance h is greater than distance H, either a workpiece is not present on workpiece support surface 34, or a clearance space is present between the workpiece situated on workpiece support surface 34 and workpiece support surface 34.

Figure 8A:
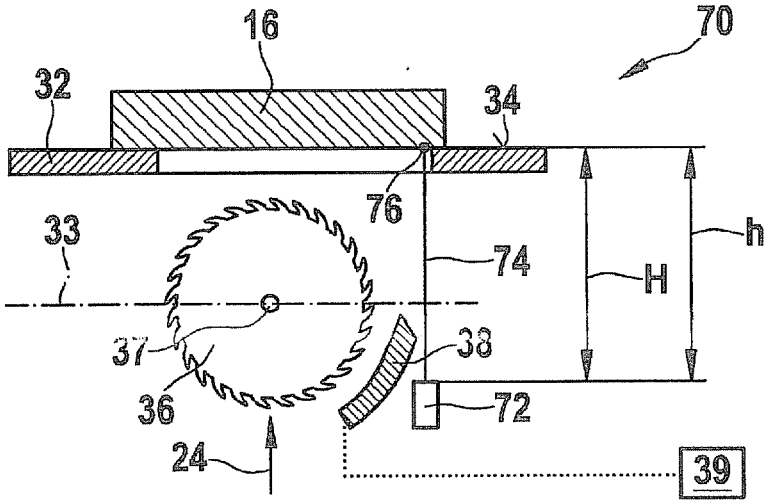
FIGS. 8*a*, 8*b*, 8*c*, 8*d* and 8*e* show schematic views of states of a table circular saw according to a sixth specific embodiment of the present invention during an inset cut, in which a through cut is made in a workpiece.
Figure 8B:
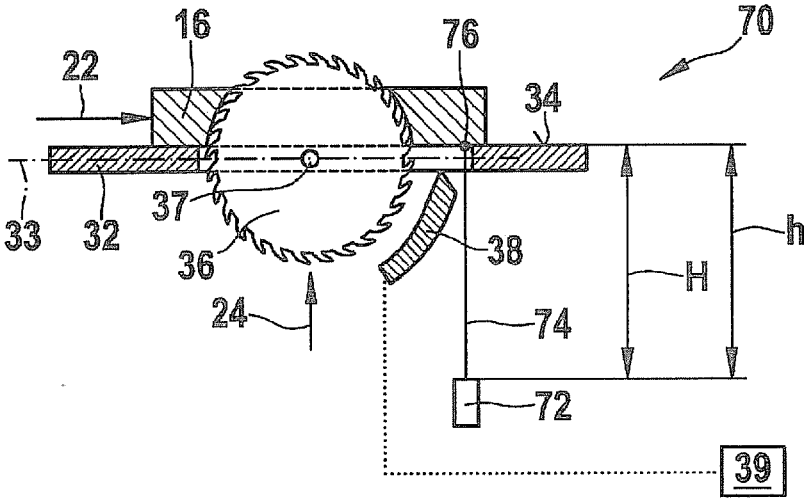

To make the inset cut, saw blade 36 which rotates about rotational axis 37 is now moved upward toward arrow 24 so that it penetrates workpiece 16, as shown in FIG. 8*b*. A through cut is made in this way. In this state, distance h ascertained by sensor unit 72 is still equal to distance H.

Figure 8C:
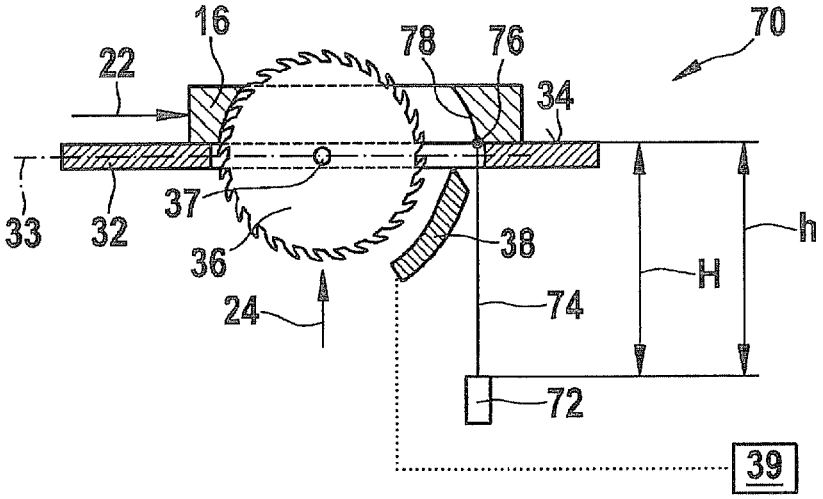
Figure 8D:
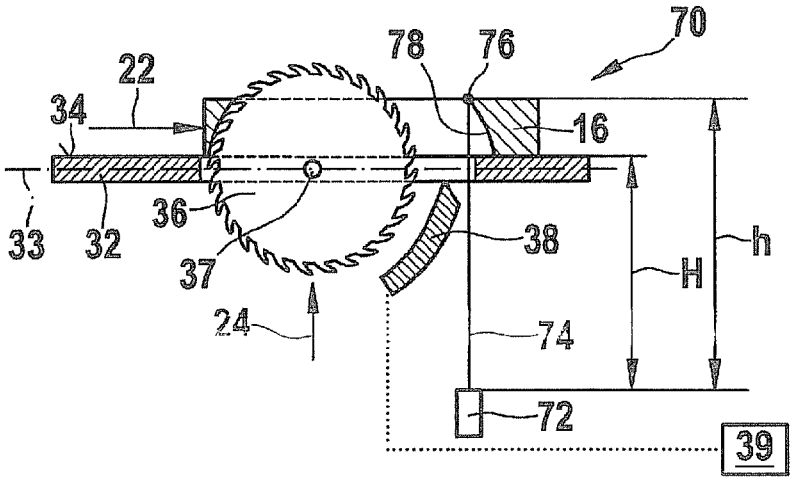
Figure 8E:
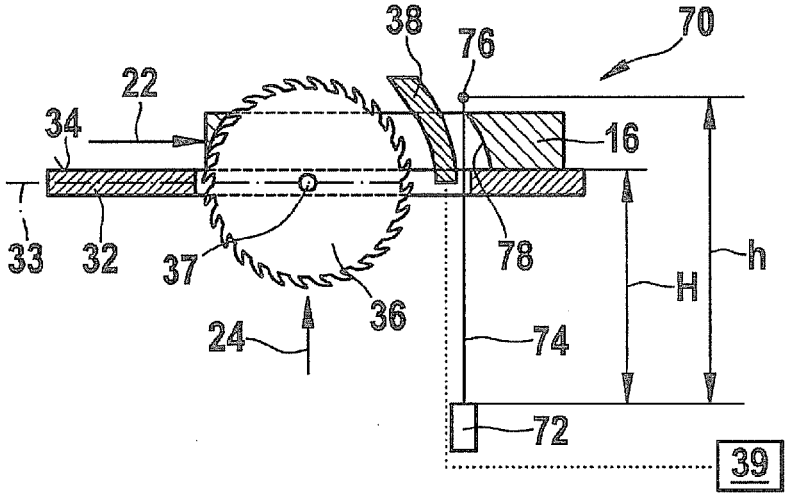

When workpiece 16 is moved in the feed direction indicated by arrow 22, the through cut is lengthened. FIG. 8*c* shows the state in which workpiece 16 has reached the position in which the beginning of cutting edge 78 forms reflection point 76. Here as well, distance h computed by sensor unit 72 is still equal to distance H.

If workpiece 16 is now moved farther in the feed direction, distance h to reflection point 76 gradually increases along cutting edge 78 until light beam 74 penetrates the through cut and is no longer reflected. This indicates that workpiece material is not present in the region occupied by splitting wedge 38 in its first position. Splitting wedge 38 may thus be moved to its first position by drive arrangement 39, so that the splitting wedge is able to perform its guiding and protective function.

Sensor unit 72 and drive arrangement 39 for transferring movable splitting wedge 38 from the second position to the first position thus allow splitting wedge 38 to be moved very early to the first position in which it performs its guiding and protective function. The hazard potential from table circular saw 70 may accordingly be minimized.

Figure 9A:
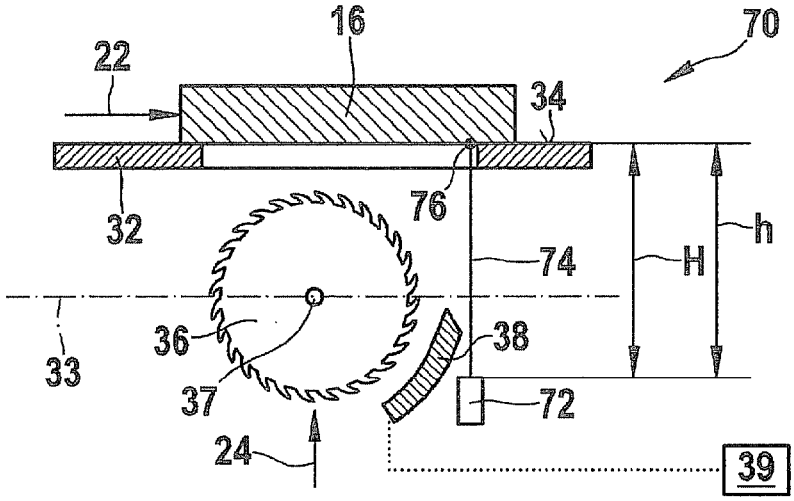
FIGS. 9*a*, 9*b*, 9*c*, 9*d* and 9*e* show schematic views of states of the table circular saw illustrated in FIGS. 8*a* through 8*e* during an inset cut, in which a non-through cut is made in a workpiece.
Figure 9B:
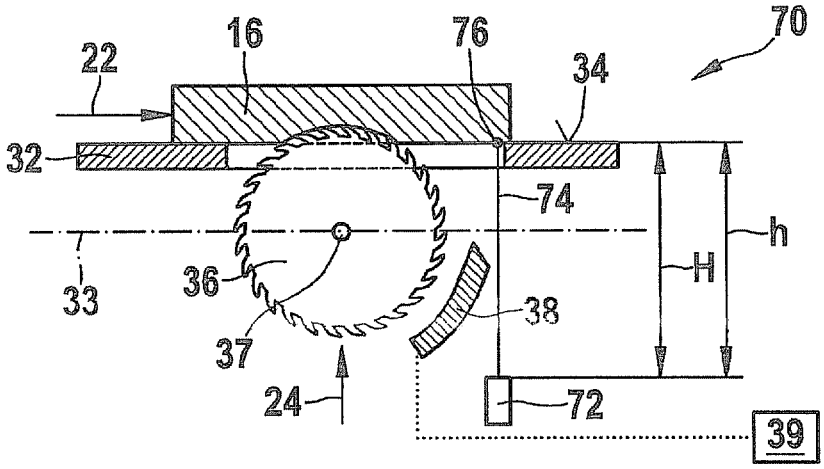

FIGS. 9*a* through 9*e* show schematic views of table circular saw 70 illustrated in FIGS. 8*a* through 8*e*, and show states while making an inset cut in which a nonthrough cut is made. Starting from the state illustrated in FIG. 9*a*, in which workpiece 16 is situated above rotating saw blade 36, saw blade 36 moves upward toward arrow 24 and penetrates workpiece 16, as shown in FIG. 9*b*. Distance h computed by sensor unit 72 is equal to distance H.

Figure 9C:
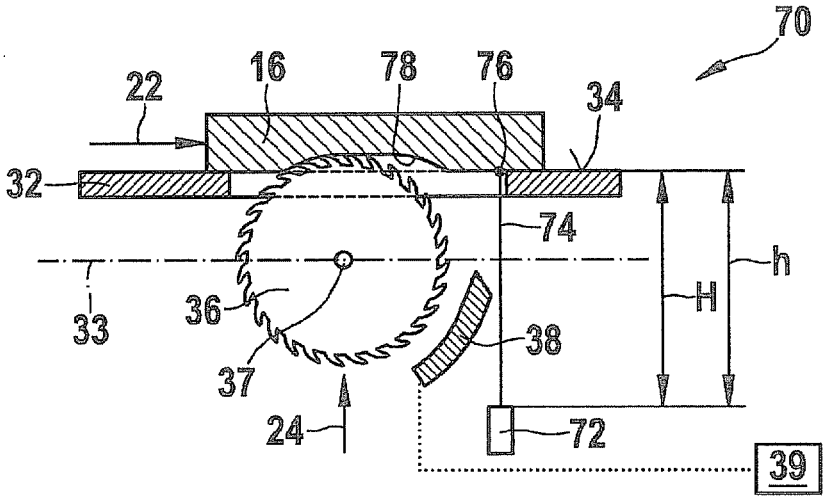
Figure 9D:
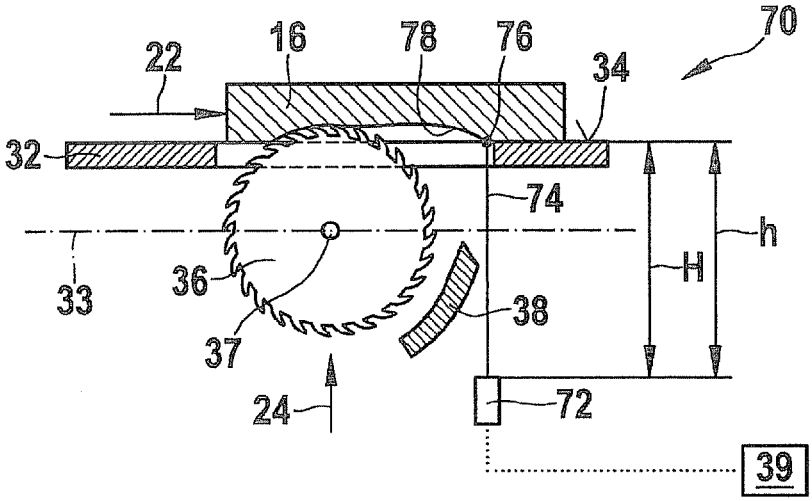
Figure 9E:
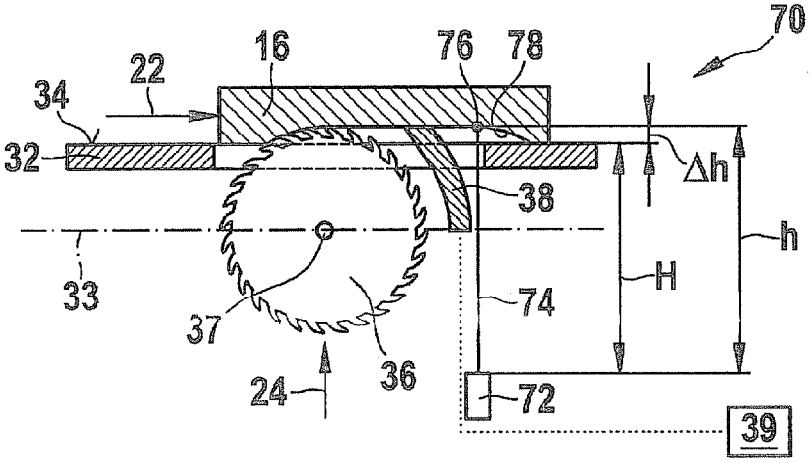

When workpiece 16 is now moved forward toward arrow 22, the incision is gradually lengthened as illustrated in FIGS. 9*c* through 9*e*. In the state shown in FIG. 9*d*, sensor unit 72 measures distance h to the beginning of cutting edge 78, distance h still being equal to distance H. From that point on, distance h becomes increasingly greater as workpiece 16 is further advanced, until the maximum depth of the cut is reached. As soon as distance h is greater than distance H, the drive arrangement is activated, causing splitting wedge 38 to be moved upward into the cut by distance $\Delta h$, $\Delta h$ being equal to the difference between distance h and distance H. In other words, sensor unit 72 and the drive arrangement provide that movable splitting wedge 38 is introduced into the cut provided in workpiece 16 at the earliest possible point in time and is accordingly able to perform its guiding function.

Figure 10A:
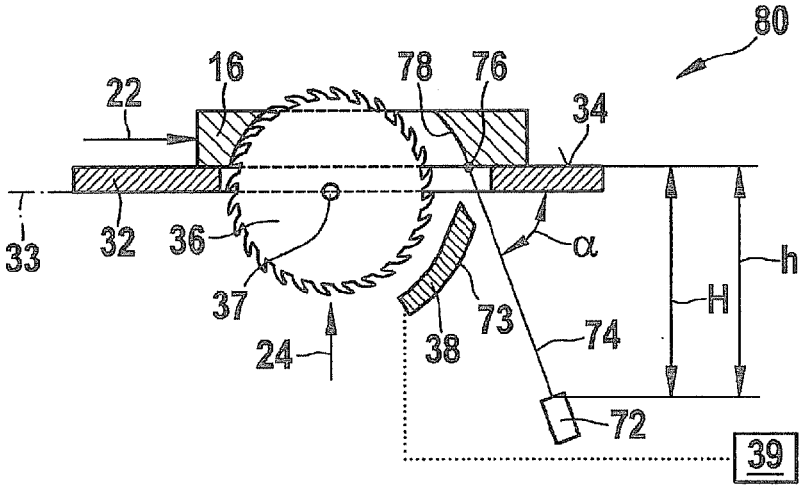
FIG. 10*a* and FIG. 10*b* show schematic views of states of a table circular saw according to a seventh specific embodiment of the present invention during an inset cut, in which a through cut is made in a workpiece.
Figure 10B:
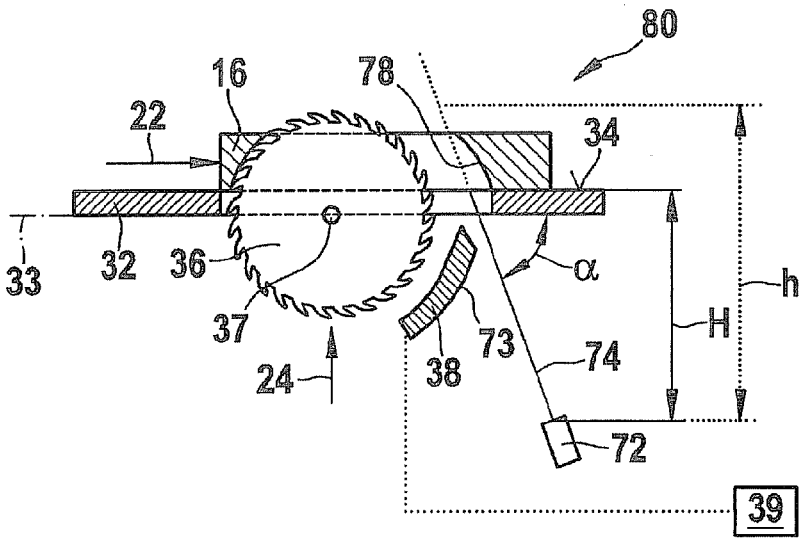

FIGS. 10*a* and 10*b* show schematic views of a table circular saw 80 according to a seventh specific embodiment of the present invention, and show states while making an inset cut in which a through cut is made in a workpiece. Table circular saw 80 essentially corresponds to table circular saw 70. Whereas sensor unit 72 for table circular saw 70 emits a light beam 74 at an angle of 90° with respect to workpiece support surface 34, angle $\alpha$ for table circular saw 80 differs from 90° ($\alpha$ is between 0° and)90°. In the present case $\alpha$ is selected in such a way that it extends parallel to a tangent to saw blade 36, and in the state in which splitting wedge 38 is in its second position is directed to the point on workpiece support surface 34 at which outer edge 73 of splitting wedge 38 is located when splitting wedge 38 is in its proper first position.

In FIG. 10*a* this point coincides with the beginning of cutting edge 78, so that distance h is equal to distance H. As soon as workpiece 16 is moved a short distance farther toward arrow 22, light beam 74 passes through the incision as illustrated in FIG. 10*b*, and distance h is suddenly greater than distance H, or distance h is not measurable at all since reflection no longer occurs. As a result, with the aid of drive unit 39 splitting wedge 38 is transferred by an appropriate extent from the second position toward the first position, so that the splitting wedge is able to perform its function. The configuration of sensor unit 72 according to this seventh specific embodiment compared to that of the sixth specific embodiment has the advantage that splitting wedge 38 is transferred to its first position at an even earlier point in time.

Figure 11A:
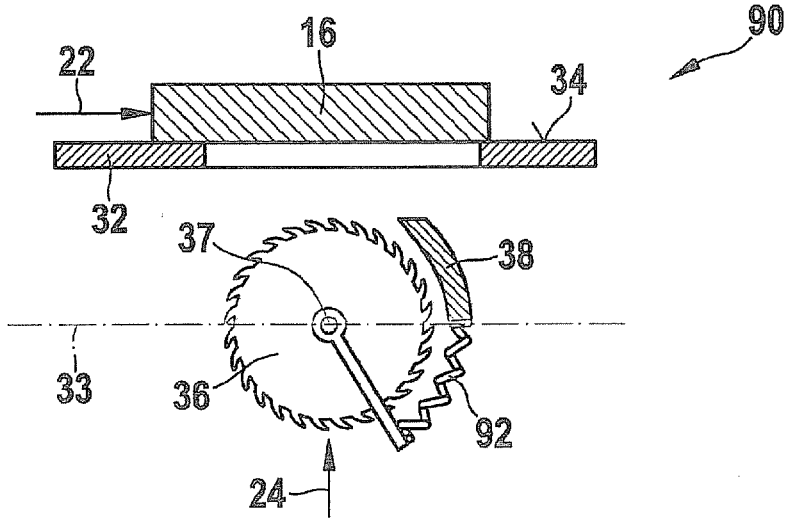
FIGS. 11*a*, 11*b* and 11*c* show schematic views of states of a table circular saw according to an eighth specific embodiment of the present invention during an inset cut, in which a through cut is made in a workpiece.
Figure 11B:
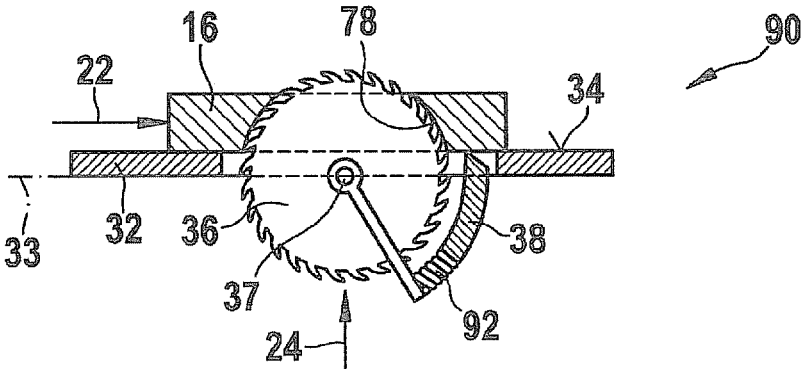
Figure 11C:
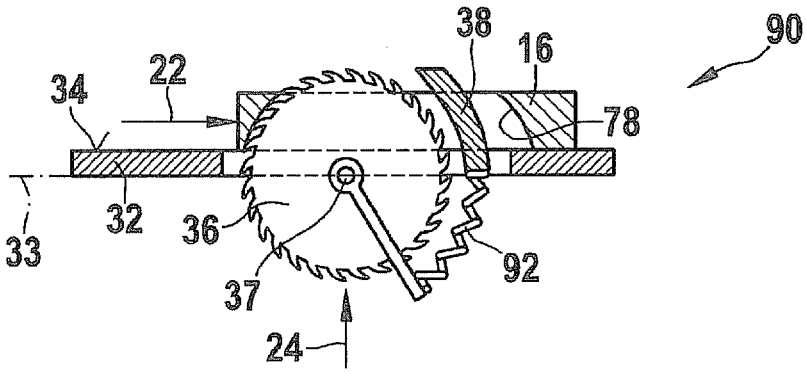

FIGS. 11*a* through 11*c* show schematic views of a table circular saw 90 according to an eighth specific embodiment of the present invention, and show states while making an inset cut in which a through cut is made in a workpiece. Similarly as for the previously described specific embodiments, table circular saw 90 includes a saw table 32 having a workpiece support surface 34, a saw blade 36 which rotates about a rotational axis 37, and a splitting wedge 38 which may be moved relative to rotational axis 37, and which may be moved relative to rotational axis 37 between a first position in which the splitting wedge extends along a region of the outer periphery of the saw blade during machining of a workpiece and engages with the workpiece to be machined, and a second position in which the splitting wedge is retracted with respect to the workpiece during machining of the workpiece and accordingly does not engage with the workpiece.

A pretensioning arrangement 92 in the form of a spring is provided beneath splitting wedge 38 which pretensions splitting wedge 38 toward its first position. To make an inset cut, splitting wedge 38 is first transferred from its first position, against the pretensioning force of spring arrangement 92, to its second position, which may be carried out manually or with the aid of an appropriate drive arrangement such as, for example, a servomotor or the like. Splitting wedge 38 is then fixed in the second, lower position, using a retaining arrangement (not illustrated), so that the splitting wedge is held in the retaining arrangement. A workpiece 16 is then placed on workpiece support surface 34 of saw table 32 above saw blade 36, whereupon the fixing provided by the retaining arrangement is once again released. Splitting wedge 38 is then held in the second position by the intrinsic weight of workpiece 16. The pretensioning force of pretensioning arrangement 92 is thus selected in such a way that it is weak enough that workpiece 16 is not pushed upward by this force. The state illustrated in FIG. 11*a* is reached once again.

When the rotating saw blade is now moved upward toward arrow 24 toward workpiece 16, the saw blade penetrates workpiece 16 as illustrated in FIG. 11*b*, thus making a through cut. When workpiece 16 is now moved forward toward arrow 22, the beginning of cutting edge 78 reaches splitting wedge 38. When workpiece 16 is then moved farther, a clearance space results above splitting wedge 38, due to the incision provided in workpiece 16, into which splitting wedge 38 is pressed due to the pretensioning force of pretensioning arrangement 92, until the splitting wedge has reached the first position illustrated in FIG. 11*c*. Thus, in this specific embodiment of the circular saw according to the present invention it is ensured, using a very simple arrangement, that movable splitting wedge 38 performs its guiding and/or protective function at the earliest possible point in time.

It is to be self-evident that the previously described specific embodiments are in no way limiting. In particular, the exemplary embodiments and/or exemplary methods of the present invention is not limited to table circular saws, and may also be used for hand-held circular saws, for example. In addition, many different types of sensors may be used as the sensor unit, as explained at the outset. It is also pointed out that features of the individual specific embodiments may also be combined with one another, thus creating new specific embodiments.

Altogether, the previously described specific embodiments are intended only as examples, it being obvious to those skilled in the art that changes and modifications may be made without departing from the scope of protection of the present invention which is defined herein.

What is claimed is:

1. A circular saw, comprising:

a saw blade for being rotatingly driven about a rotational axis;

a workpiece support surface supporting a workpiece being cut by the saw blade;

a sensor unit calculating a distance between a surface of the workpiece and the workpiece support surface, wherein the sensor unit is capable of calculating the depth of a nonthrough cut;

at least one first splitting wedge swivelable about the rotational axis of the saw blade; and a drive arrangement for swiveling the first splitting wedge about the rotational axis of the saw blade to a position where the first splitting wedge protrudes through the workpiece support surface based on the calculated distance between a surface of the workpiece and the workpiece support surface.

* * * * *